US006950070B2

(12) United States Patent
Lindell

(10) Patent No.: US 6,950,070 B2
(45) Date of Patent: Sep. 27, 2005

(54) ARRANGEMENT FOR A MOBILE TERMINAL

(75) Inventor: Bo Lindell, Lidingö (SE)

(73) Assignee: Telefonaktiebolaget LM Ericsson, Stockholm (SE)

( * ) Notice: Subject to any disclaimer, the term of this patent is extended or adjusted under 35 U.S.C. 154(b) by 0 days.

(21) Appl. No.: 10/475,151

(22) PCT Filed: Apr. 17, 2002

(86) PCT No.: PCT/EP02/04254

§ 371 (c)(1),
(2), (4) Date: Oct. 14, 2003

(87) PCT Pub. No.: WO02/087010

PCT Pub. Date: Oct. 31, 2002

(65) Prior Publication Data

US 2004/0113852 A1 Jun. 17, 2004

Related U.S. Application Data

(60) Provisional application No. 60/287,082, filed on Apr. 26, 2001.

(30) Foreign Application Priority Data

Apr. 19, 2001 (EP) ..... 01109651

(51) Int. Cl.[7] ..... H01Q 1/24

(52) U.S. Cl. ..... 343/702; 343/745; 343/846

(58) Field of Search ..... 343/702, 846, 343/848, 850, 860, 745; 455/89, 90.3

(56) References Cited

U.S. PATENT DOCUMENTS

| | | | | | |
|---|---|---|---|---|---|
| 3,742,511 | A | * | 6/1973 | Smith et al. | 343/750 |
| 4,491,843 | A | | 1/1985 | Boubouleix | 343/702 |
| 5,701,128 | A | | 12/1997 | Okada et al. | 343/700 |
| 5,914,696 | A | * | 6/1999 | Vanderhelm et al. | 343/841 |
| 6,107,967 | A | | 8/2000 | Hill | 343/702 |
| 6,342,859 | B1 | * | 1/2002 | Kurz et al. | 343/702 |
| 6,580,397 | B2 | * | 6/2003 | Lindell | 343/702 |
| 6,597,319 | B2 | * | 7/2003 | Meng et al. | 343/702 |
| 6,657,595 | B1 | * | 12/2003 | Phillips et al. | 343/702 |
| 6,721,611 | B2 | * | 4/2004 | Schneider et al. | 700/84 |

* cited by examiner

*Primary Examiner*—Tan Ho
(74) *Attorney, Agent, or Firm*—Jenkens & Gilchrist, P.C.

(57) ABSTRACT

A mobile terminal (1), comprising a casing (2), which accommodates radio electronic circuits (REC) and a screening device (SD) for the radio electronic circuits, comprises an antenna system comprising an end-fed antenna (EA), having an extended shape, presenting a first end and a second end and being connected to the radio electronic circuits (REC). A counterpoise element (5) is located near the first end of the end-fed antenna (EA), the end-fed antenna being adapted to be fed against the counterpoise element (5) by the radio electronic circuits (REC). A tuning network (TN) is located near the second end of the end-fed antenna (EA). The tuning network (TN) is adapted to adjust the electrical length of the antenna so as to assume a value corresponding to a multiple of a half wave-length of the frequencies used.

11 Claims, 6 Drawing Sheets

ARRANGEMENT FOR A MOBILE TERMINAL

This patent application claims priority from and incorporates by reference the entire disclosure of U.S. provisional patent application No. 60/287,082, which was filed on Apr. 26, 2001.

TECHNICAL FIELD OF THE INVENTION

The present invention refers to an antenna system for a mobile terminal and a portable communications device, according to the preamble of claim 1 and 7, respectively.

DESCRIPTION OF RELATED ART

The patent application SE0003951-1, filed Oct. 27, 2000 the subject matter of which forms the preamble of claim 1, discloses an antenna system for a mobile terminal, comprising an end-fed antenna, having an extended shape, and a counterpoise element, located near the first end of the end-fed antenna, the end-fed antenna being adapted to be fed, during transmission, against the counterpoise element.

It is favorable for such an antenna having an electrical length corresponding approximately to the wavelength of the frequency, or frequencies, on which the antenna is intended to transmit or receive. Frequencies commonly used in mobile telephone communications are 900 and 1800 MHz. In mobile terminal technology, there has been, and continues to be, a trend towards decreasing the size of the terminals themselves. It is therefore difficult to meet requirements on the antenna's electrical length by adjusting its physical length, since this would result in the antenna being too large.

In the art different approaches has been made to accomplish the desired electrical length of the antenna. It is known to use a tuning inductor and a capacitive hat on antennas to get resonance and to change the current distribution, (see ARRL Antenna Handbook). In WO9954956 extentions in the form of conductive patterns on a movable flap are used to obtain a larger antenna. These extensions form an essential part of the radiating structure.

SUMMARY

It is an object of the present invention to improve the efficiency of an antenna system for a mobile terminal.

The object is met by an antenna system and a portable communications device, having the characterizing features of claim 1 and 7, respectively.

Using a tuning network according to the invention makes it possible to achieve an antenna having an electrical length corresponding to multiples of half a wave-length of the frequency used, without having to utilize an antenna presenting dimensions being too large to meet demands on the terminal itself.

Preferably the tuning network comprises a conducting element, with an extended shape and oriented in the transverse direction of the end-fed antenna. This will be favorable for the goal to reduce the size of the mobile terminal, since the tuning network, being oriented in the transverse direction of the antenna, and therefore the terminal itself, will have only a minor effect on the length of the mobile terminal.

BRIEF DESCRIPTION OF THE DRAWINGS

The invention will now be described in greater detail, with the aid of the accompanying drawings, on which

DETAILED DESCRIPTION OF EMBODIMENTS

Figure 1:
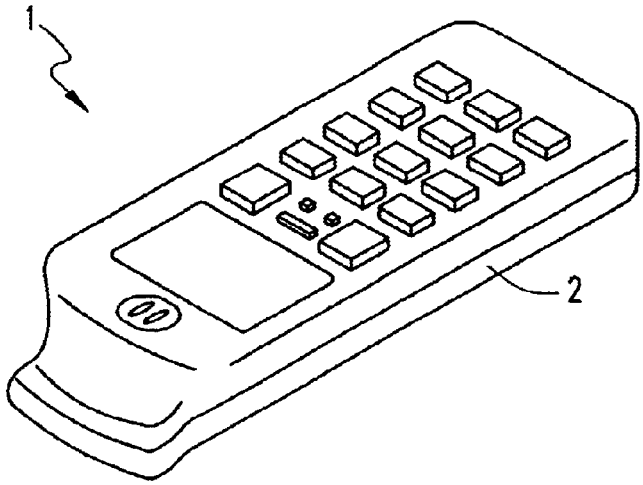
FIG. 1 shows a schematic perspective view of a mobile terminal, equipped with an antenna system according to a first embodiment of the present invention.

FIG. 1 shows a mobile terminal 1, equipped with an antenna arrangement according to a first embodiment of the present invention. A wide array of different industrial designs for the mobile terminal are possible, and the appearance of the mobile terminal 1 in FIG. 1 is exemplifying only. The mobile terminal 1 comprises a main casing 2, having an extended shape.

Figure 2:
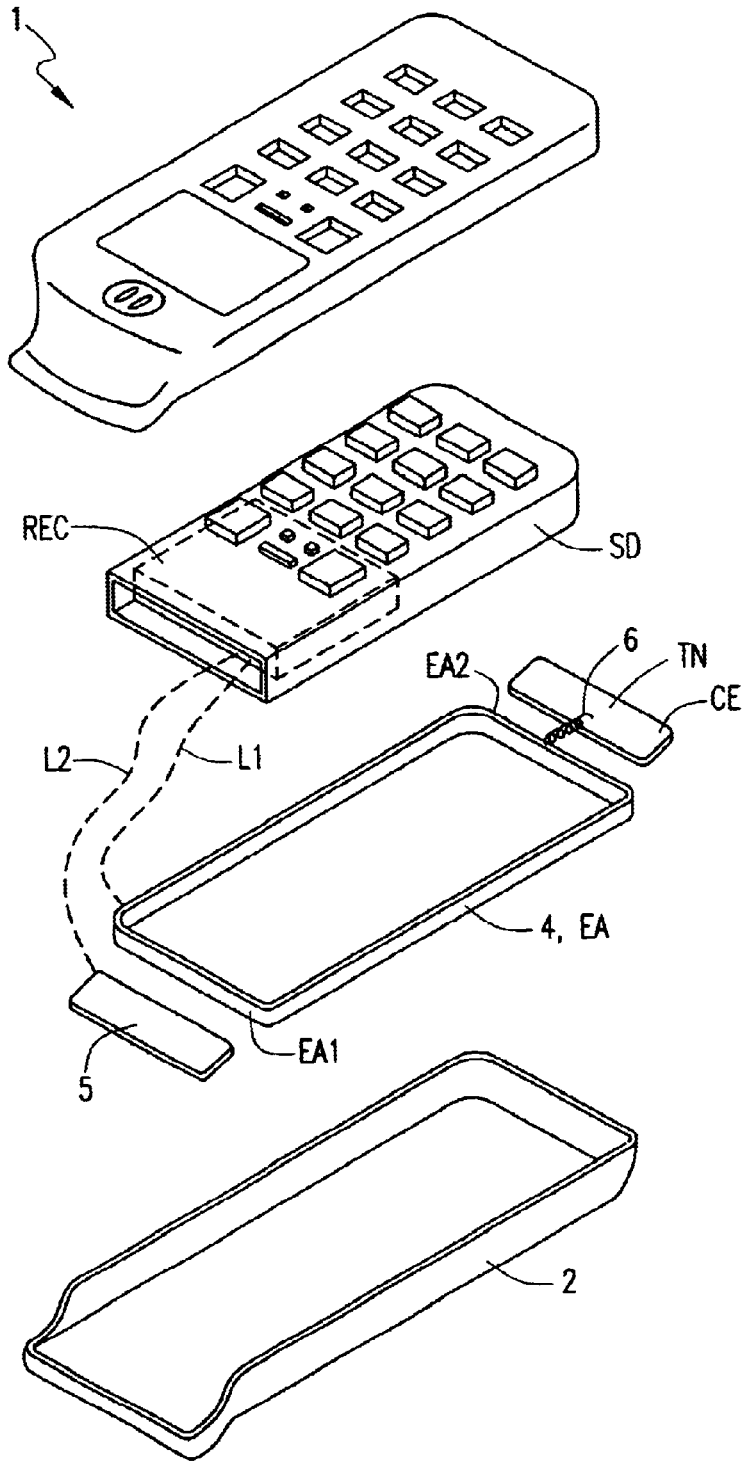
FIG. 2 shows a schematic exploded view of the mobile terminal from FIG. 1.

FIG. 2 shows an exploded view of the mobile terminal in FIG. 1. It comprises a screened compartment, or screening device SD, having a box-like shape. The screening device SD encloses radio electronic circuits REC, indicated with broken lines in FIG. 2.

A terminal chassis 4, having an extended shape and serving as a structural frame for the mobile terminal 1, is located within the main casing 2. As is described in SE0003951-1 the terminal chassis can serve as an end-fed antenna EA. The end-fed antenna EA presents a first end EA1 and a second end EA2. A counterpoise element 5 for the end-fed antenna EA is located near the first end EA1. The radio electronic circuits REC are connected between the end-fed antenna EA and the counterpoise 5, as illustrated by the broken lines L1 and L2, respectively.

Near the second end EA2 of the end-fed antenna EA a tuning network TN is located. As will be described in more detail below, the tuning network TN is adapted to adjust the electrical length of the antenna so as to assume a value corresponding to a multiple of a half wave-length of the frequencies used.

In the first embodiment of the invention the tuning network TN comprises a conducting element CE and an inductor 6. The conductive element CE presents a relatively large capacitive reactance, but a small resistance. The conducting element CE consists of a metal plate, located at a small distance from the second end EA2.

The conducting element CE can be held in place in the mobile terminal 1 by means of a holder, not shown, secured on the chassis 4, the holder being made of an insulating material. Alternatively the counterpoise 5 can be secured against the screening compartment, or other suitable component of the mobile terminal 1, whereby the fastening means for the counterpoise element 5 is made out of a non-conductive material.

In FIG. 2 the conducting element CE is shown as an essentially flat metal plate with an extended shape, being oriented transversely of the end-fed antenna EA. Preferably, the length of the conducting element is substantially the same as the width of the mobile terminal 1.

In FIG. 2 the metal plate is leaned in a direction towards the front side of the mobile terminal 1. However, the orientation of the conducting element CE in its transverse direction has no substantial effect on its functional efficiency. As an alternative the metal plate could lean towards the back side of the mobile terminal 1. It could also be aligned with the end-fed antenna 4.

Furthermore the conducting element CE could be an extended metal plate having a curved cross section. It could also have the shape of a cylinder, having its axis transversely of the end-fed antenna EA.

The inductance 6 connects the conducting element CE to the second end EA2 of the end-fed antenna EA, at which the inductance 6 is connected in series with the conducting element CE.

Figure 3:
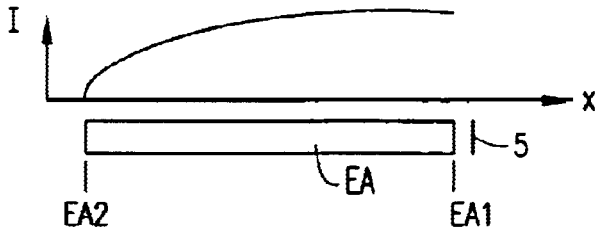
FIG. 3 shows a diagram of a current distribution along an antenna.

FIG. 3 shows a diagram where the x-axis is parallel to the longitudinal axis of the end-fed antenna EA. The current distribution I is shown in the case no tuning network is used at the second end EA2 of the antenna EA. The current is zero at the second end EA2, but the maximum current occurs close to the first end EA1.

Figure 4:
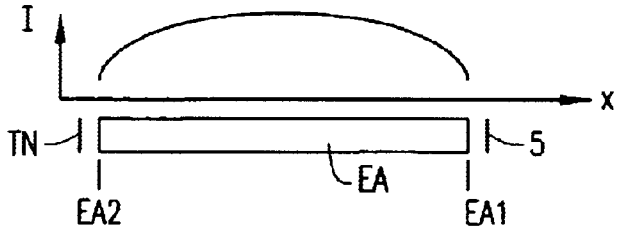
FIG. 4 shows a diagram of a current distribution along an antenna.

In FIG. 4 the current distribution I is shown in the case a tuning network TN is used according to the invention at the second end EA2 of the antenna EA. The antenna EA has a higher impedance than in the case shown in FIG. 3, so that it corresponds to the end-impedance of a half-wave antenna. The location of the maximum current is altered and it occurs at or close to the middle of the antenna EA. This results in a larger band-width compared to the arrangement shown in FIG. 3.

Obtaining the current distribution shown in FIG. 4, leads to the electrical length of the antenna EA corresponding to half a wave-length at a frequency used. At half-wave-length resonance the impedance of the end-fed antenna is increased. As a result the impedance of the counterpoise 5, although having the same absolute value, will be smaller in relation to the antenna impedance. The larger antenna moment achieved will result in making the bandwidth larger. It will also simplify matching the antenna EA, being fed against the counterpoise 5.

It is important to note that the tuning network TN itself is not intended to provide radiation.

Figure 5:
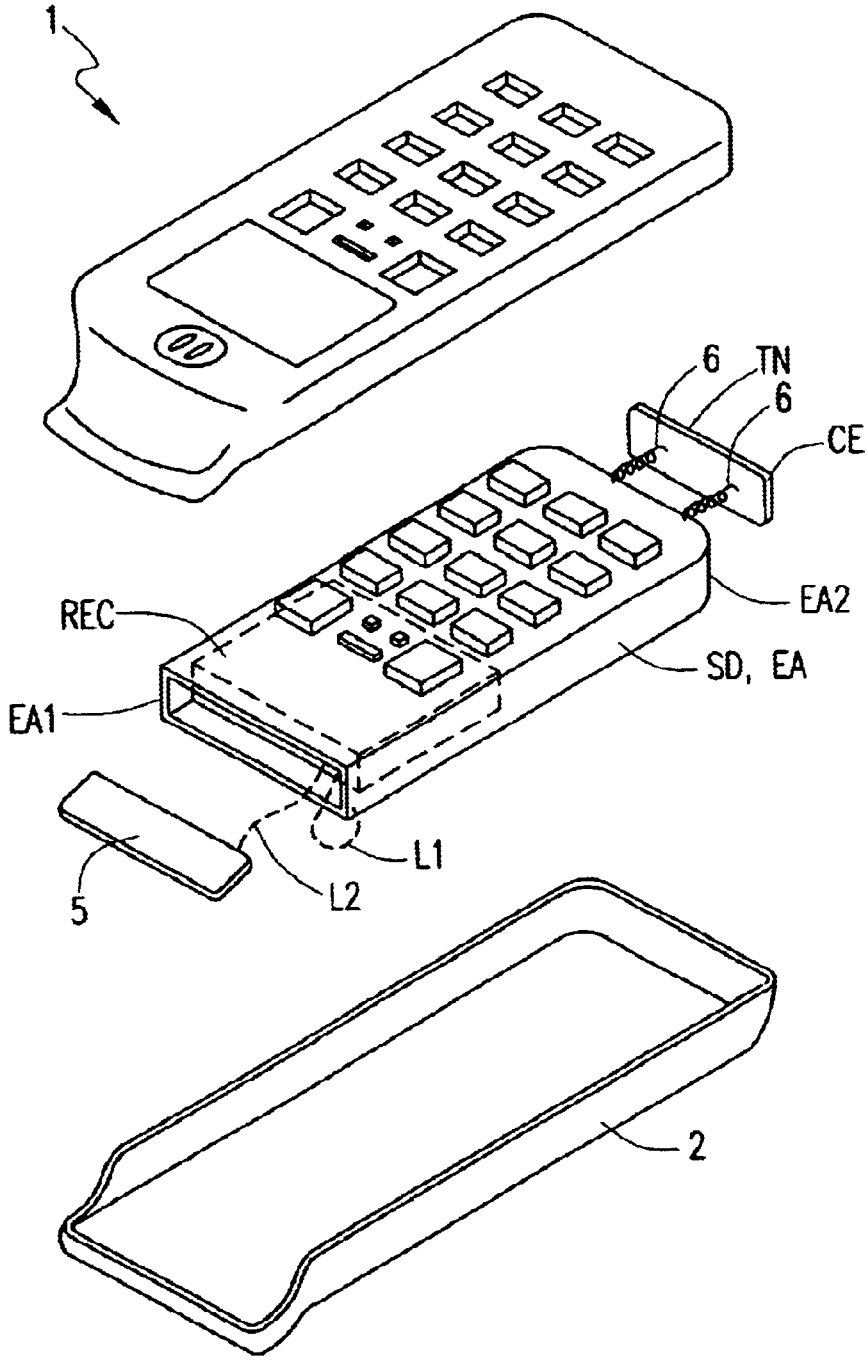
FIG. 5 shows a schematic exploded view of a mobile terminal, equipped with an antenna system according to a second embodiment of the present invention.

FIG. 5 shows a second embodiment of the present invention. Here the screening device SD serves as the end-fed antenna EA, presenting a first end EA1 and a second end EA2. The connection from the radio electronic circuits REC to the screening device SD and the counterpoise 5 is represented by the broken lines L1 and L2, respectively.

Near the second end EA2 of the end-fed antenna EA a tuning network TN is located, comprising a conducting element CE and two inductors 6. The conductive element CE presents similar features as the one described in connection to FIG. 2 above, with the exception of its transverse orientation. Its plane is substantially perpendicular to the longitudinal axis of the end-fed antenna EA.

The inductances 6 connects the conducting element CE to the second end EA2 of the end-fed antenna EA, at which the inductances 6 is connected in series with the conducting element CE. Alternatively, more than two inductances could be used. The object of having more than one inductance is to reduce the current concentration, thus reducing the local field strength, making the tuning of the electrical length of the antenna EA less sensitive to adjacent objects. The inductors be presented in the form of discrete inductors or a pattern on a printed circuit board.

Figure 6:
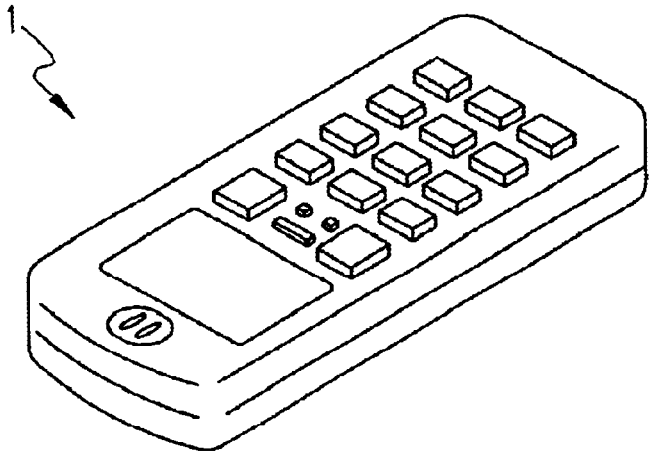
FIG. 6 shows a schematic perspective view of a mobile terminal, equipped with an antenna system according to a third embodiment of the present invention.
Figure 7:
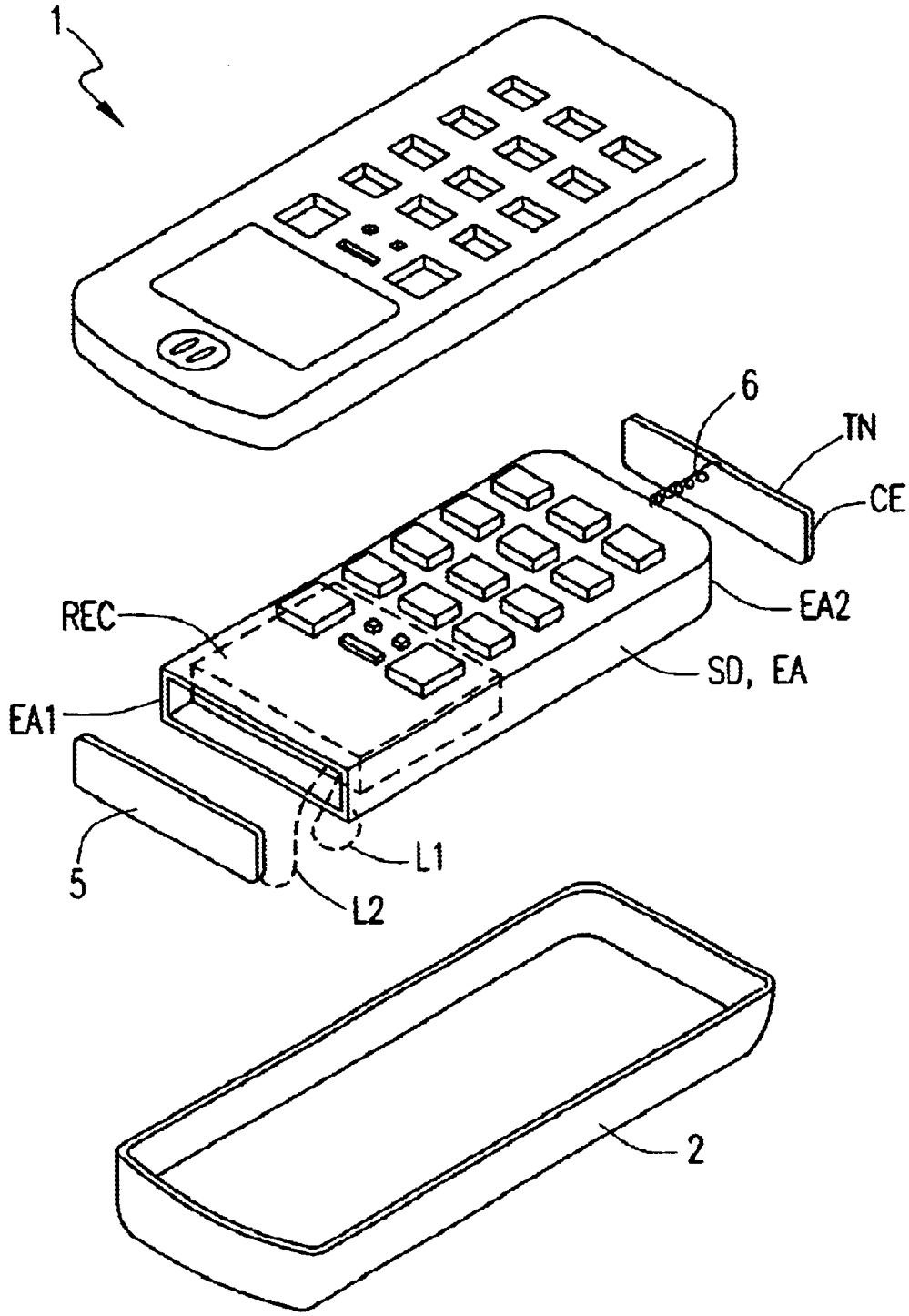
FIG. 7 shows a schematic exploded view of the mobile terminal from FIG. 6.

The FIGS. 6–7 depict a mobile terminal 1 equipped with an antenna system according to a third embodiment of the present invention. A casing 2 encloses both a counterpoise element 5 and a screening device SD for radio electronic circuits REC. As in FIG. 5, the screening device SD serves as an end-fed antenna EA, presenting a first end EA1 and a second end EA2. Both the counterpoise 5, near the first end EA1, and a conducting element CE of a tuning network TN, near the second end EA2, are in the form of metal strips, each extending in the transverse direction of the end-fed antenna EA. The cross section of each metal strip is oriented transversely of the longitudinal direction of the end-fed antenna EA.

As an alternative the casing of the mobile terminal, or part thereof, may serve as an end-fed antenna fed against a counterpoise element, at which a tuning network according to the present invention is provided.

Figure 8:
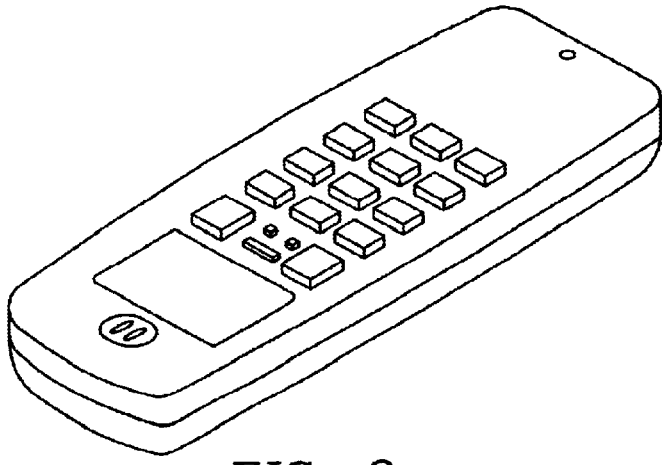
FIG. 8 shows a schematic perspective view of a mobile terminal, equipped with an antenna system according to a fourth embodiment of the present invention.
Figure 9:
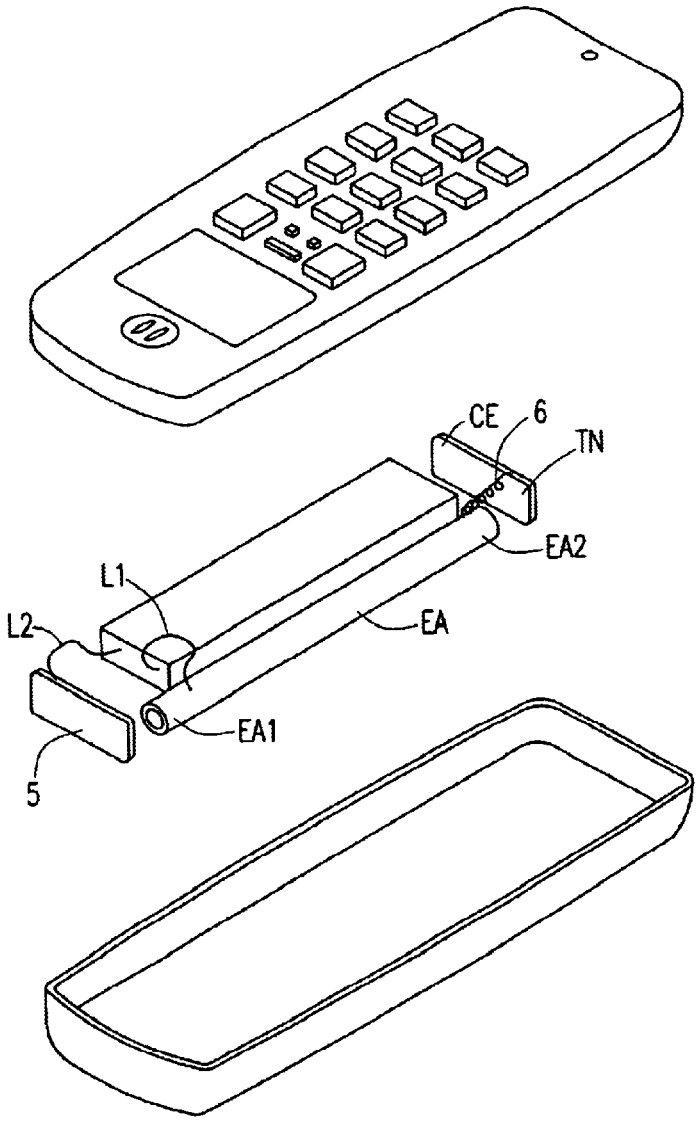
FIG. 9 shows a schematic exploded view of the mobile terminal from FIG. 8.

FIGS. 8–9 shows a mobile terminal equipped with an antenna system according to a fourth embodiment of the present invention. Radio electronic circuits REC are connected to a separate end-fed antenna EA with an extended shape and a counterpoise element 5, located near a first end EA1 of the antenna EA. The antenna shown is a tube with a round cross-section. However, the antenna can have any suitable form, being solid or tube-formed, presenting an extended shape with, for example square or rectangular cross-section.

Near a second end EA2 of the antenna EA a tuning network is provided with a conducting element CE and an inductor 6 similar to what has been described above. Preferably the conductive element CE is oriented transversely of the antenna EA, and extends the full width of the inner space of the mobile terminal casing.

In the case the end-fed antenna is intended to transmit and receive signals on more than one frequency band, the tuning network can be arranged to adjust the electrical length of the end-fed antenna individually for each band. This can be achieved by a tuning network comprising a conducting element, for example in the form of a metal strip with an extended shape, arranged at an end of the antenna being opposite to the one at which a counterpoise element is located, in the same manner as described above. A circuit connecting the conduction element with the antenna is adapted to allow the antenna to obtain, for each band, an electrical length corresponding thereto.

The features of the embodiments described above can be combined in any manner desired. Any of the antenna forms described above, whether it is separate, a chassis, screening or casing for the mobile terminal, can be arranged with any type of tuning network, whether it comprises one or more inductances or a circuit connecting a conducting element with the antenna.

What is claimed is:

1. An antenna system for a mobile terminal comprising a casing adapted to accommodate radio electronic circuits and a screening device for the radio electronic circuits, the antenna system comprising:

an end-fed antenna having an extended shape, presenting a first end and a second end and being connected to the radio electronic circuits;

a counterpoise element located near the first end of the end-fed antenna wherein the end-fed antenna is adapted to be fed against the counterpoise element by the radio electronic circuits; and a tuning network located near the second end of the end-fed antenna and adapted to adjust an electrical length of the end-fed antenna.

2. The antenna system according to claim 1, wherein the tuning network comprises a conducting element an extended shape and oriented in a transverse direction of the end-fed antenna.

3. The antenna system according to claim 2, wherein the tuning network comprises at least one inductance element, the at least one inductance element connecting the conducting element to the second end of the end-fed antenna.

4. The antenna system according to claim 1, wherein a terminal chassis serves as the end-fed antenna.

5. The antenna system according to claim 1, wherein the screening device serves as the end-fed antenna.

6. The antenna system according to claim 1, wherein the casing serves as the end-fed antenna.

7. The antenna system according to claim 1, wherein the tuning network does not provide any electromagnetic radiation.

8. A portable communications device comprising:

a casing adapted to accommodate radio electronic circuits;

a screening device for the radio electronic circuits; and an end-fed antenna, the end-fed antenna having an extended shape, presenting a first end and a second end, and being connected to the radio electronic circuits;

a counterpoise element located near the first end of the end-fed antenna;

wherein the end-fed antenna is adapted to be fed against the counterpoise element by the radio electronic circuits; and a tuning network located near the second end of the end-fed antenna and adapted to adjust an electrical length of the end-fed antenna.

9. The portable communications device according to claim 8, wherein the tuning network comprises a conducting element, the conducting element having an extended shape and oriented in a transverse direction of the end-fed antenna.

10. The portable communications device according to claim 9, wherein the tuning network comprises at least one inductance element connecting the conducting element to the second end of the end-fed antenna.

11. The portable communications device according to claim 8, wherein the tuning network does not provide any electromagnetic radiation.

* * * * *